US006244182B1

(12) United States Patent
Lin et al.

(10) Patent No.: US 6,244,182 B1
(45) Date of Patent: Jun. 12, 2001

(54) ANTI-EXPANSION WEB-TRANSFER MECHANISM FOR A COLOR PRESS

(75) Inventors: Chung Hsien Lin; Ting Chen Yu, both of Taipei (TW)

(73) Assignee: Hueiloo Co., Ltd., Taipei (TW)

( * ) Notice: Subject to any disclaimer, the term of this patent is extended or adjusted under 35 U.S.C. 154(b) by 0 days.

(21) Appl. No.: 09/427,719

(22) Filed: Oct. 27, 1999

(51) Int. Cl.[7] ..... B41J 22/00
(52) U.S. Cl. ..... 101/480; 101/494
(58) Field of Search ..... 101/219, 228, 101/232, 494, 485, 480; 226/189; 242/615.2; 271/188, 209

(56) References Cited

U.S. PATENT DOCUMENTS 5,598,778 * 2/1997 Iijima et al. ..... 101/485
5,678,484 * 10/1997 Callan et al. ..... 101/226
5,820,122 * 10/1998 Schneider ..... 271/88

FOREIGN PATENT DOCUMENTS 8-156234 * 6/1996 (JP) .
9-216334 * 8/1997 (JP) .

* cited by examiner

*Primary Examiner*—Daniel J. Colilla
(74) *Attorney, Agent, or Firm*—Rosenberg, Klein & Lee

(57) ABSTRACT

An anti-expansion web-transfer mechanism mounted between two printing units in a color press to transfer a printed web from one printing unit to a next printing unit, and to prevent the printed web from expanding in width, the anti-expansion web-transfer mechanism including a fixed axle and a rotary axle arranged in parallel between two brackets, a plurality of roller supports respectively mounted on the two axles in stagger to hold a respective roller, a transmission mechanism controlled to rotate the rotary axle, enabling the rollers at the roller supports at the rotary axle to be pressed on the printed web against the rollers at the roller supports at the fixed axle, and an air cylinder connected between the transmission mechanism and one roller support at the rotary axle.

4 Claims, 9 Drawing Sheets

ANTI-EXPANSION WEB-TRANSFER MECHANISM FOR A COLOR PRESS

BACKGROUND OF THE INVENTION

The present invention relates to a color press, and more specifically to an anti-expansion web-transfer mechanism mounted between two printing units in a color press to transfer the web from one printing unit to a next printing unit, and to prevent the printed web from expanding in width.

When processing a color printing in a color press, the web is printed color by color through different printing units in the press. When printed through one printing unit, the web may expand in width due to absorption of ink and water. As illustrated in FIG. 1, if the width of the web expands from set width D to expanded with D', the web becomes unable to be accurately moved over the printing plate at the next printing unit. When this condition occurs, the printing plate at each printing unit must be respectively adjusted to fit the expanded web. However, it is complicated to adjust the position of the printing plate at each printing unit.

SUMMARY OF THE INVENTION

It is the main object of the present invention to provide an anti-expansion web transfer mechanism for a color press, which prevents the printed web from expanding in width. According to one aspect of the present invention, the anti-expansion web-transfer mechanism comprises a fixed axle and a rotary axle arranged in parallel between two brackets, a plurality of roller supports respectively mounted on the two axles in stagger to hold a respective roller, a transmission mechanism controlled to rotate the rotary axle, enabling the rollers at the roller supports at the rotary axle to be pressed on the printed web against the rollers at the roller supports at the fixed axle, and an air cylinder connected between the transmission mechanism and one roller support at the rotary axle. According to another aspect of the present invention, the transmission mechanism comprises a mounting block pivoted to one bracket, a nut mounted in the mounting block, a driven gear fixedly mounted on the nut outside the mounting block, a screw rod threaded into the nut, the screw rod having a coupling portion extended from one end thereof and coupled to one roller support at the rotary axle through the air cylinder, a stop block fixedly mounted on the coupling portion of the screw rod and stopped at one side of the bracket to which the mounting block is connected, a motor mount fastened to the mounting block at a bottom side, a reversible motor mounted on the motor mount, and a driving gear meshed with the driven gear and driven by the reversible motor to rotate the driven gear.

DETAILED DESCRIPTION OF THE PREFERRED EMBODIMENT

Figure 1:
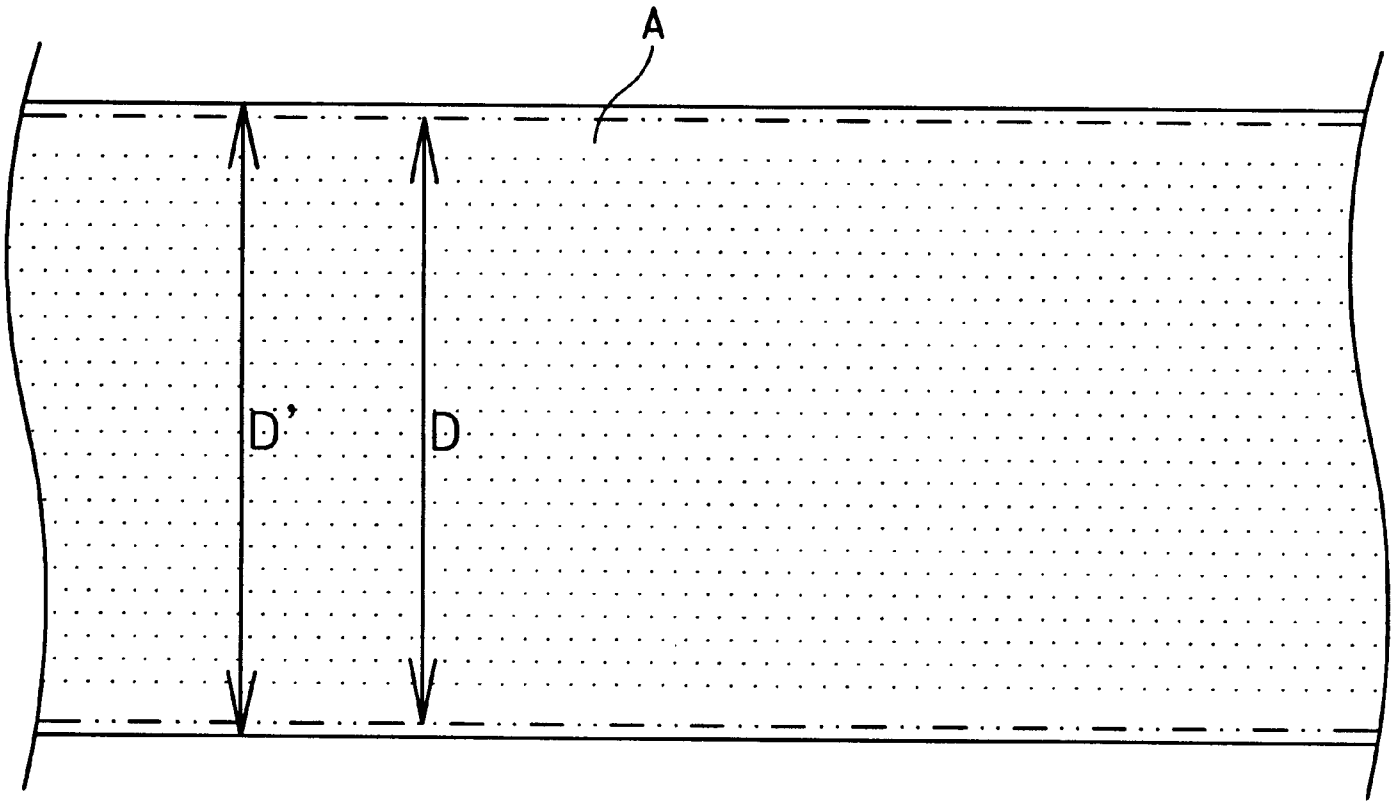
(PRIOR ART) FIG.1
FIG. 1 is a schematic drawing showing the web expanded in width after absorption of ink and water.

Referring to FIGS. 2, 2A, 2B, 3 and 4, the present invention comprises a first bracket 102 and a second bracket 104 fixedly arranged in parallel, a first axle 12 and a second axle 14 coupled in parallel between the brackets 102 and 104, a plurality of roller supports 20 respectively mounted on the axles 12 and 14 in a staggered manner, a plurality of rollers 252 respectively mounted on the roller supports 20, and a transmission mechanism 30 mounted on the first bracket 102. The roller supports 20 each comprise a clamping hole 22, which receives the axle 12 or 14 for enabling the respective roller support 20 to be about the axle 12 or 14 (see FIG. 3), a tightening up screw 24 controlled to fix the respective roller support 20 to the axle 12 or 14 and to stop the respective roller support 20 from rotary motion relative to the axle 12 or 14, a substantially U-shaped opening 26 at one end, two axle holes 262 aligned at two opposite lateral sides of the U-shaped opening 26, and a pivot 264 mounted in the axle holes 262 to hold a respective roller 266.

Figure 2A:
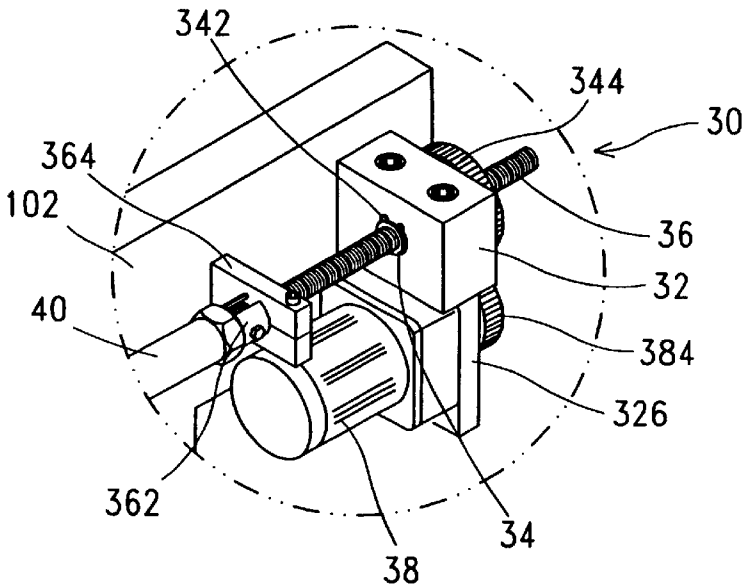
FIG. 2A is an enlarged view of a part of FIG. 2.
Figure 2:
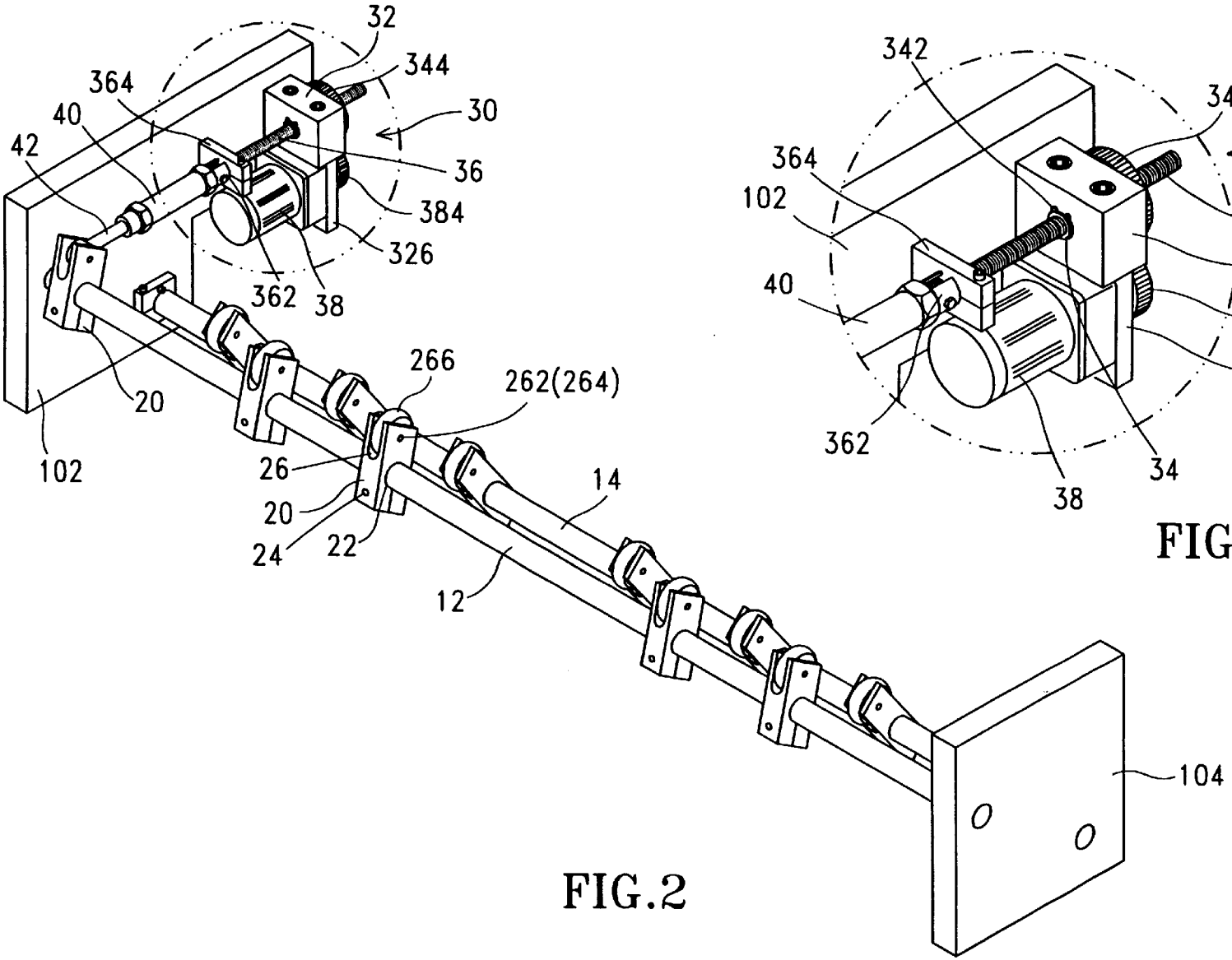
FIG. 2 is a perspective view of the present invention.
Figure 2B:
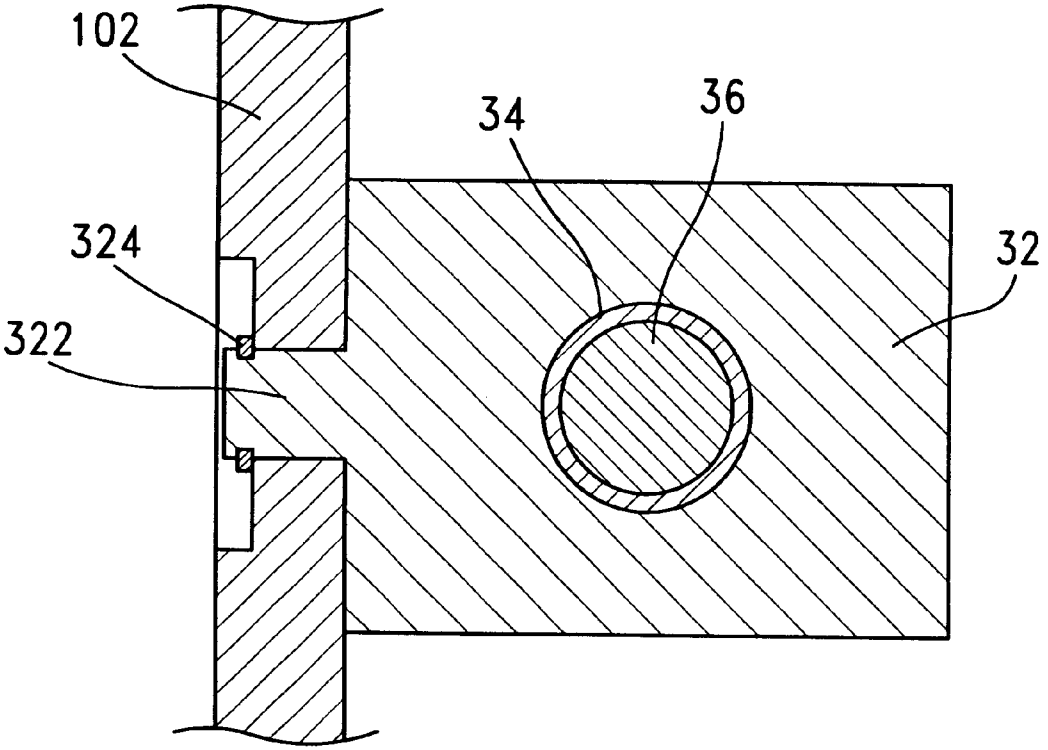
FIG. 2B is a sectional view in an enlarged scale of a part of FIG. 2, showing the mounting block of the transmission mechanism coupled to the first bracket.
Figure 3:
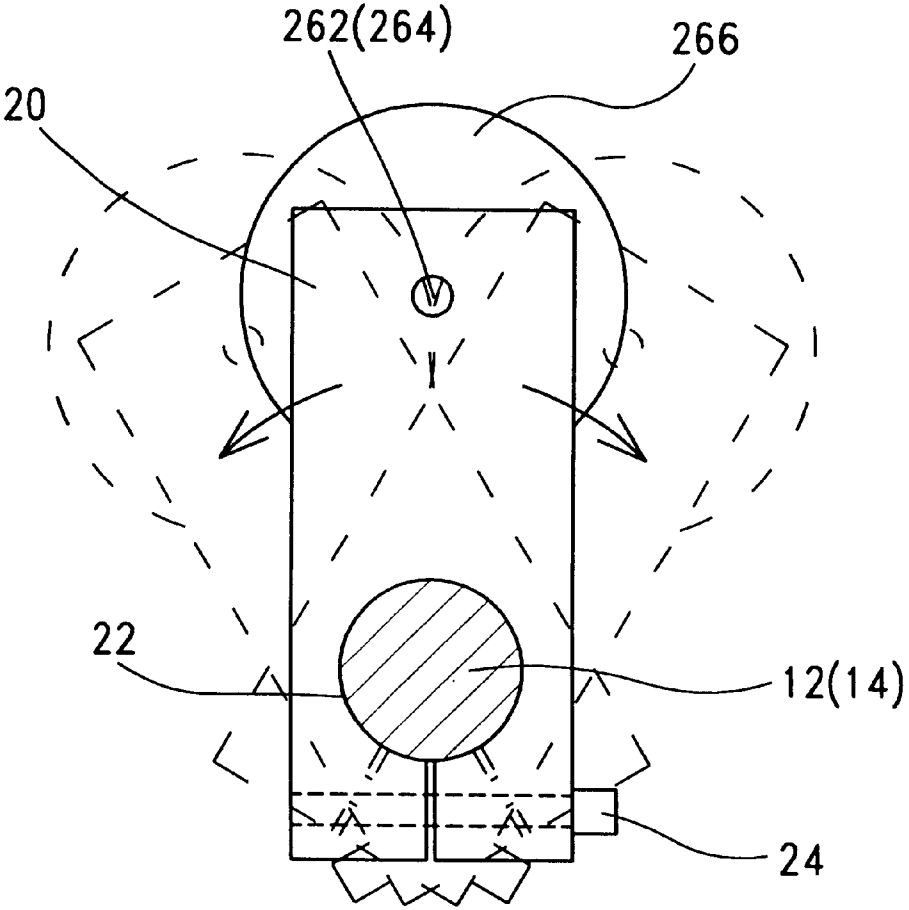
FIG. 3 is a schematic drawing showing the roller support adjusted relative to the axle according to the present invention.
Figure 4:
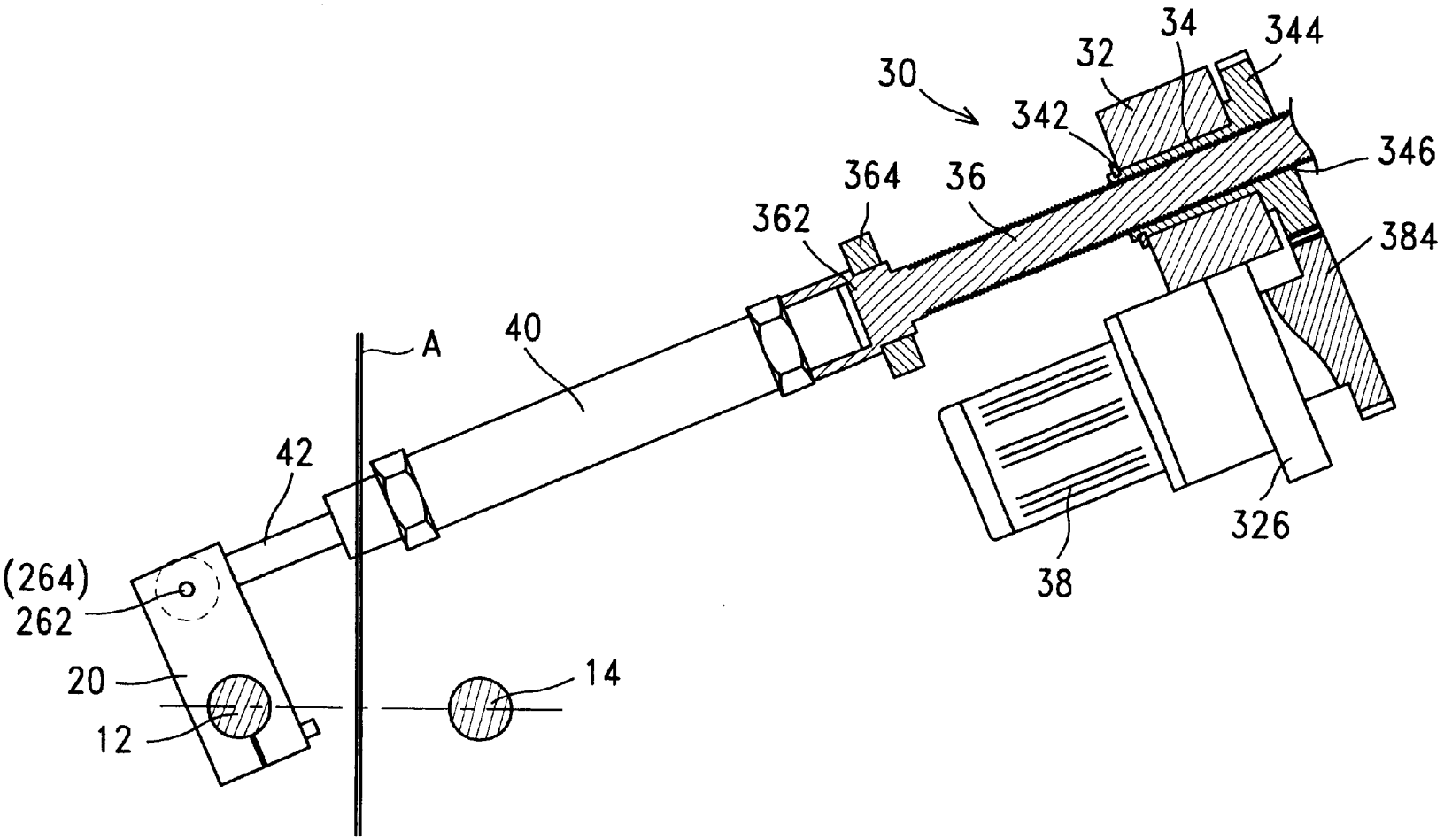
FIG. 4 is a side view in section of the present invention.
Figure 4A:
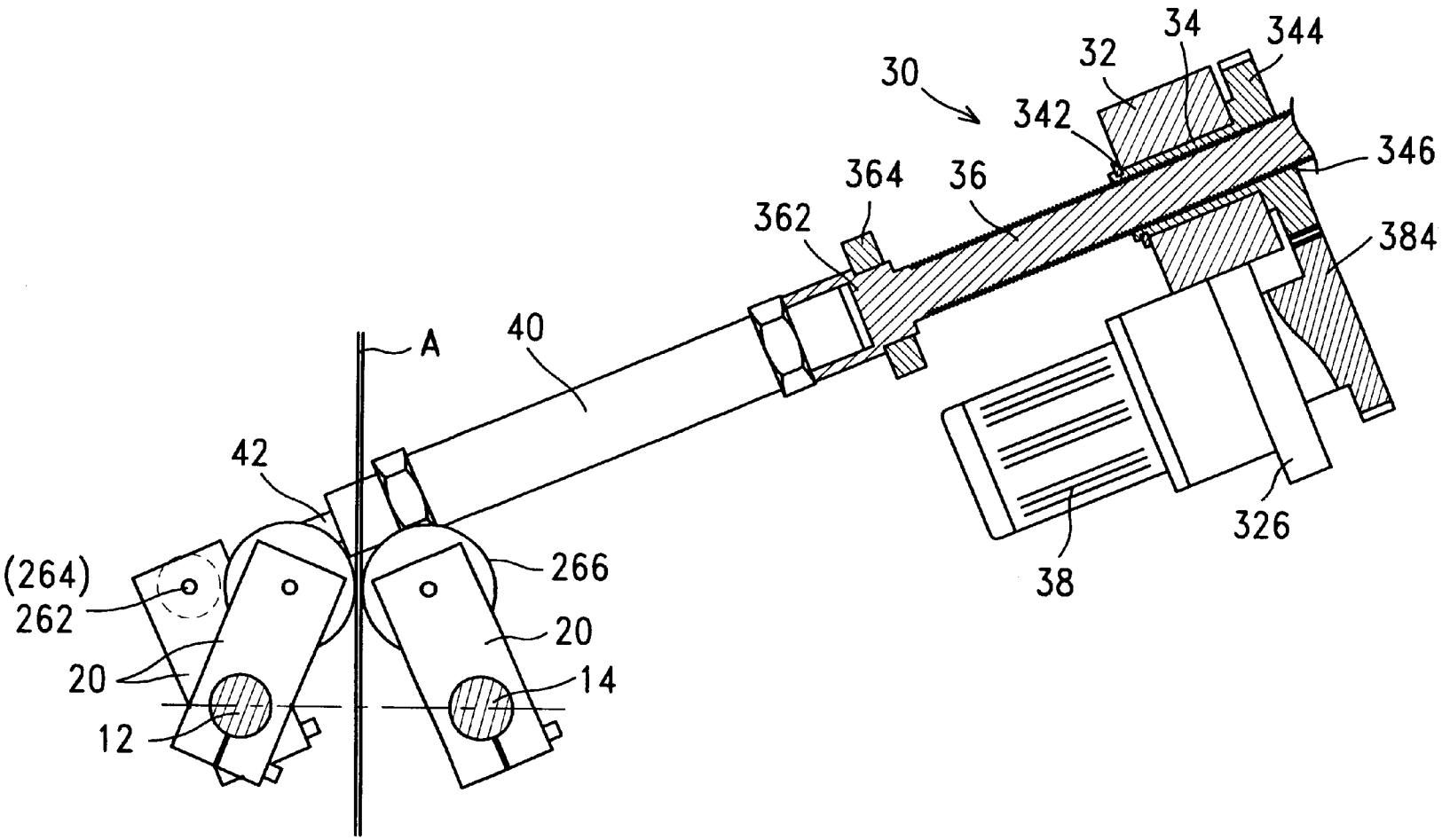

Referring to FIGS. 2A and 2B, the transmission mechanism 30 comprises a mounting block 32 pivoted to the first bracket 102, the mounting block 32 comprises a mounting shaft 322 raised from one lateral side thereof and inserting through a through hole at the first bracket 102 in direction from the front side wall of the first bracket 102 toward the back side wall thereof, a clamp 324 mounted on the mounting shaft 322 and stopped at the back side wall of the first bracket 102 to secure the mounting block 32 to the first bracket 102, enabling the mounting block 32 to be turned with the mounting shaft 322 in the through hole at the first bracket 102, a cylindrical nut 34 mounted in a through hole at the mounting block 32, a clamp 342 fastened to the cylindrical nut 34 and stopped at one side of the mounting block 32 to secure the nut 34 to the mounting block 32, a driven gear 344 fixedly mounted on the cylindrical nut 23 and disposed at one side of the mounting block 32 opposite to the clamp 342, a screw rod 36 threaded into the screw hole 346 in the cylindrical nut 34, the screw rod 36 having a coupling portion 362 at one end, a stop block 364 fixedly mounted around the coupling portion 263 of the screw rod 36 and stopped against the front side wall of the first bracket 102, an air cylinder 40 connected to the coupling portion 362 of the screw rod 36, the air cylinder 40 having a movable end, namely, the piston rod 42 pivoted to the pivot 264 at one roller support 20 at the first axle 12, a motor mount 326 fastened to the mounting block 32 at a bottom side, a reversible motor 38 mounted on the motor mount 326, and a driving gear 384 coupled to the output shaft of the motor 38 and meshed with the driven gear 344 (see FIG. 4).

Figure 5:
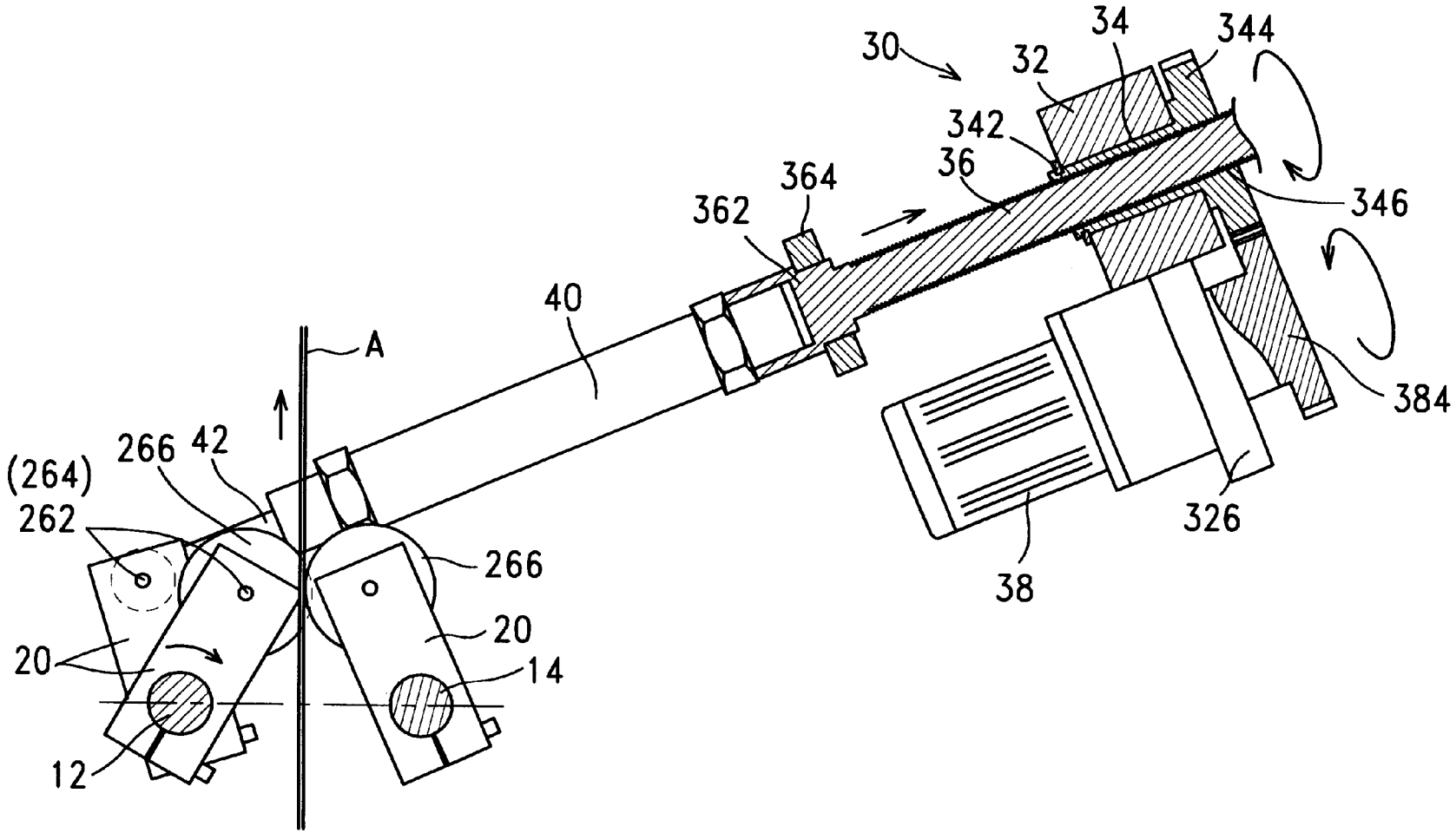
FIG. 5 is an applied view of the present invention, showing the piston extended out, the roller supports turned with the first axle away from the web.
Figure 6:
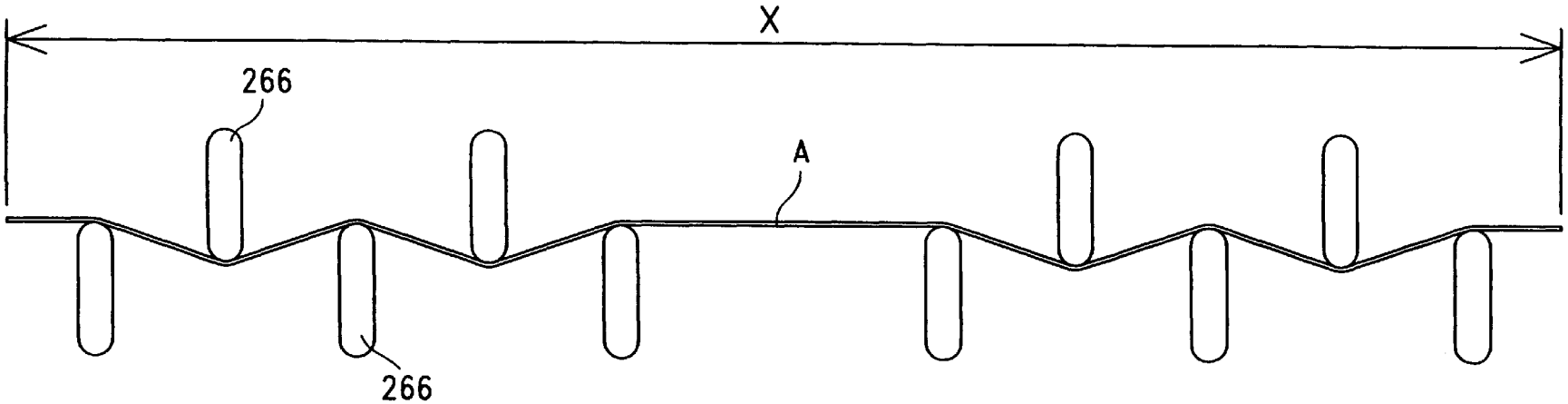
FIG. 6 is schematic top view, showing the rollers pressed on both sides of the web, the web corrugated.
Figure 7:
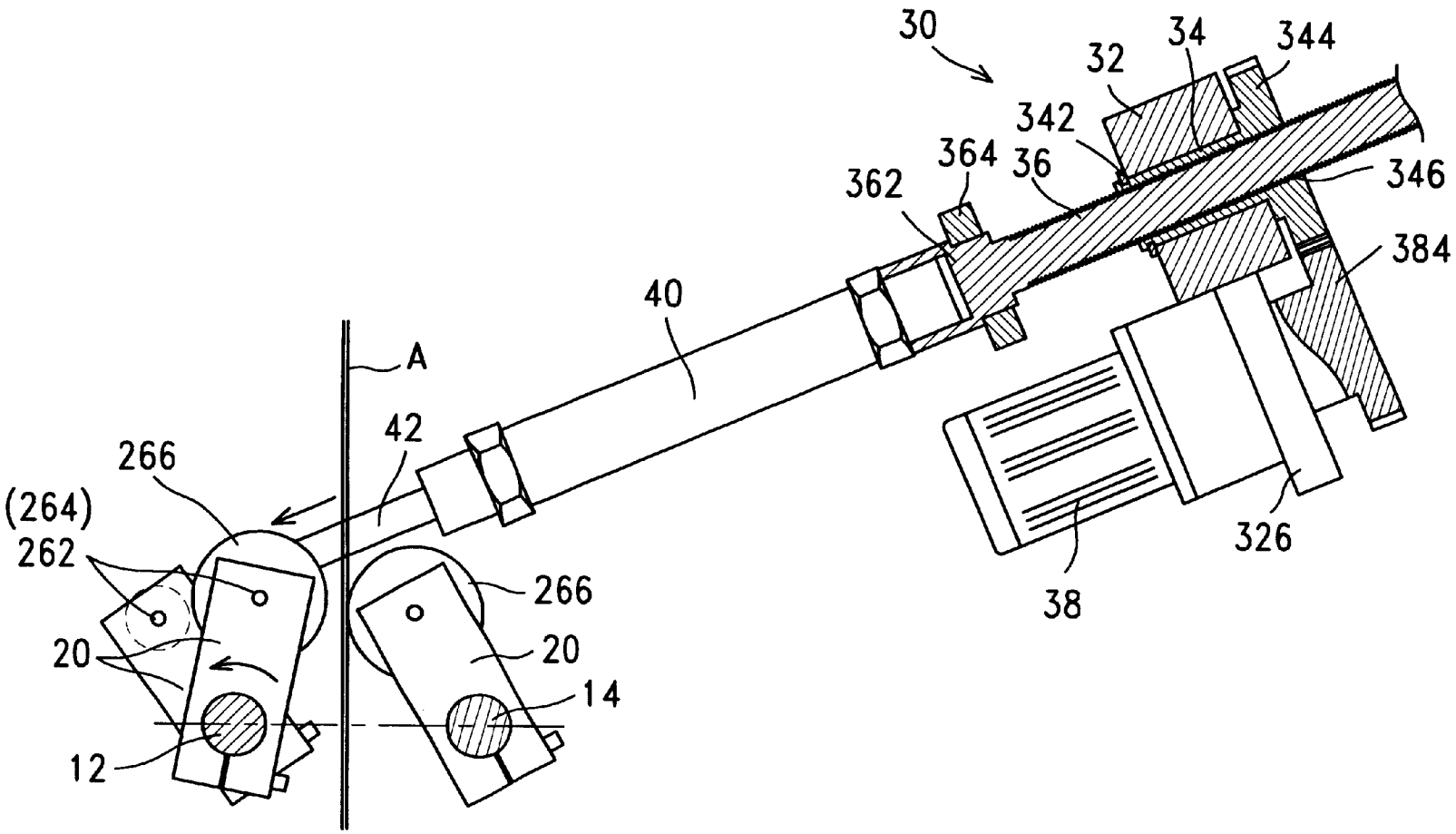
FIG. 7 is another side view in section of the present invention, showing the web delivered through the gap between the first axle and the second axle, the rollers pressed on both sides of the web.

Referring to FIGS. 5 through 7, the present invention is mounted between two printing units in a color press. During printing, web A is transferred forwards through the gap between the first axle 12 and the second axle 14. When passing through the gap between the axles 12 and 14, the web A is stretched into a corrugated condition by the rollers 266 at the roller supports 20 at the axles 12 and 14 (see FIG. 6), thereby causing the apparent width, the distance between opposing longitudinal sides, of the web A to be adjusted to the set dimension X. Therefore, after being passed through one printing unit in the color press, the web A is automatically forced by the rollers 266 to reduce the distance between the sides and thereby adjust its otherwise expanded width (due to absorption of ink) to an apparent width having the set dimension X between receiving a next printing process at a next printing unit. When the web A is transferred through the gap between the axles 12 and 14, the reversible motor 38 is started to turn the driven gear 344 via the driving gear 384, thereby causing the screw rod 36 to be moved forwards in the nut 34. When the screw rod 36 is moved forwards, the corresponding roller support 20 is pulled by the piston rod 42 of the air cylinder 40, thereby causing the first axle 12 to be rotated on its own axis through an angle relative to the second axle 14, and therefore the rollers 266 at the roller supports 20 at the first axle 12 are pressed on the web A against the rollers 266 at the roller supports 20 at the second axle 14.

The web used in the color press is a continuous sheet of paper rolled up into a roll. When one roll of paper is used up, a second roll of paper is installed in the color press for printing. Because different rolls of paper have different tensile strength, different pressure should be employed to the web through the rollers 266 subject to the tensile strength of the web. By means of controlling the operation of the reversible motor 38 to move the air cylinder 40, the first axle 12 can be quickly rotated to the desired angle by the piston rod 42 of the air cylinder 40. Further, by extending the piston rod 42 out of the air cylinder 40, the first axle 12 is rotated to move the rollers 266 at the roller supports 20 at the first axle 12 away from the web A passing through the gap between the axles 12 and 14.

While only one embodiment of the present invention has been shown and described, it will be understood that various modifications and changes could be made thereunto without departing from the spirit and scope of the invention disclosed.

What the invention claimed is:

1. An anti-expansion web-transfer mechanism mounted between two printing units in a color press to transfer a web from one printing unit to a next printing unit, and to prevent the printed web from expanding in width, the anti-expansion web-transfer mechanism comprising:

a first bracket and a second bracket fixedly arranged in parallel;

a first axle coupled between said first bracket and said second bracket and rotated on the axle thereof;

a second axle fixedly connected between said first bracket and said second bracket and arranged in parallel to said first axle, said second axle defining with said first axle a web-transfer gap through which the printed web is delivered;

a plurality of roller supports respectively mounted on said first axle and said second axle, said roller supports each comprising a clamping hole, which receives one of said first axle and said second axle, a tightening up screw fastened up to fix the respective roller support to said first axle or said second axle and to stop the respective roller support from rotary motion relative to the respective axle;

a plurality of rollers respectively mounted on said roller supports;

a transmission mechanism controlled to rotate said first axle, enabling the rollers at the roller supports at said first axle to be pressed on the printed web in a direction opposite to the rollers at the roller supports at said second axle, said transmission mechanism comprising a mounting block pivoted to said first bracket, a nut mounted in said mounting block, a driven gear fixedly mounted on said nut and disposed outside said mounting block, a screw rod threaded into said nut, said screw rod having a coupling portion extended from one end thereof and coupled to one roller support at said first axle, a stop block fixedly mounted on the coupling portion of said screw rod and stopped at one side of said of said first bracket, a motor mount fastened to said mounting block at a bottom side, a reversible motor mounted on said motor mount, and a driving gear meshed with said driven gear and driven by said reversible motor to rotated said driven gear; and an air cylinder connected to the coupling portion of said screw rod, said air cylinder having a piston rod pivoted to one roller support at said first axle.

2. The anti-expansion web-transfer mechanism of claim 1 wherein said roller supports are respectively mounted on said first axle and said second axle in stagger.

3. The anti-expansion web-transfer mechanism of claim 1 wherein said first axle and said second axle are arranged in parallel on a plane perpendicular to the moving direction of the printed web passing through the gap between said first axle and said second axle.

4. The anti-expansion web-transfer mechanism of claim 1 wherein said roller supports each comprise a substantially U-shaped opening at one end, two axle holes aligned at two opposite lateral sides of said U-shaped opening, and a pivot mounted in said axle holes to hold one of said rollers.

* * * * *